US008801807B2

(12) United States Patent
Meyer et al.

(10) Patent No.: US 8,801,807 B2
(45) Date of Patent: Aug. 12, 2014

(54) USE OF DIETHER COMPOUNDS FOR CHEMICALLY CLEANING TEXTILE, LEATHER, OR FUR GOODS

(75) Inventors: Cord Meyer, Schlangenbad (DE); Helmut Eigen, Gau-Algesheim (DE); Manfred Seiter, Budenheim (DE)

(73) Assignee: Chemische Fabrik Kreussler & Co., GmbH, Wiesbaden (DE)

( * ) Notice: Subject to any disclaimer, the term of this patent is extended or adjusted under 35 U.S.C. 154(b) by 0 days.

(21) Appl. No.: 13/123,606

(22) PCT Filed: Jun. 14, 2010

(86) PCT No.: PCT/EP2010/058318

§ 371 (c)(1),
(2), (4) Date: Aug. 18, 2011

(87) PCT Pub. No.: WO2010/149521

PCT Pub. Date: Dec. 29, 2010

(65) Prior Publication Data

US 2012/0084928 A1 Apr. 12, 2012

(30) Foreign Application Priority Data

Jun. 25, 2009 (DE) ..... 10 2009 027 206

(51) Int. Cl.

| | |
|---|---|
| ***D06L 1/02*** | (2006.01) |
| ***D06L 1/04*** | (2006.01) |
| ***C11D 7/50*** | (2006.01) |
| ***C11D 3/43*** | (2006.01) |
| ***C11D 11/00*** | (2006.01) |
| ***C11D 3/20*** | (2006.01) |
| ***C11D 3/00*** | (2006.01) |
| *C11D 7/26* | (2006.01) |

(52) U.S. Cl.

CPC ..... *C11D 3/43* (2013.01); *C11D 7/5022* (2013.01); *C11D 11/0017* (2013.01); *C11D 3/2068* (2013.01); *D06L 1/02* (2013.01); *C11D 7/263* (2013.01); *C11D 3/0031* (2013.01)

USPC ..... 8/142

(58) Field of Classification Search

USPC ..... 8/142; 510/285, 291

See application file for complete search history.

(56) References Cited

U.S. PATENT DOCUMENTS

| | | | | |
|---|---|---|---|---|
| 3,993,697 | A * | 11/1976 | Bruns et al. | 568/591 |
| 4,418,217 | A | 11/1983 | Schmid et al. | |
| 4,783,560 | A | 11/1988 | Servais et al. | |
| 5,269,958 | A | 12/1993 | De Jager | |
| 5,585,034 | A | 12/1996 | Lysy et al. | |
| 6,558,432 | B2 | 5/2003 | Schulte et al. | |
| 7,097,715 | B1 | 8/2006 | Racette et al. | |
| 2002/0133886 | A1 * | 9/2002 | Severns et al. | 8/142 |
| 2005/0000029 | A1 * | 1/2005 | Arredondo et al. | 8/142 |
| 2005/0044636 | A1 | 3/2005 | Galick et al. | |
| 2009/0030241 | A1 | 1/2009 | Lang | |
| 2010/0040785 | A1 | 2/2010 | Lang | |

FOREIGN PATENT DOCUMENTS

| | | | |
|---|---|---|---|
| DE | 3018135 | A1 | 11/1981 |
| DE | 3032786 | A1 | 4/1982 |
| DE | 3736034 | A1 | 5/1988 |
| DE | 3904610 | A1 | 8/1990 |
| DE | 42 43 468 | | 6/1994 |
| DE | 698 14 748 | T2 | 3/2004 |
| EP | 0 743 360 | | 11/1996 |
| FR | 2268773 | A2 | 11/1975 |
| GB | 2196981 | A | 5/1988 |
| JP | 62-29538 | A | 2/1987 |
| JP | 5-51598 | | 3/1993 |
| JP | 5051598 | A | 3/1993 |
| JP | 2006-257162 | | 9/2006 |
| JP | 2007-521409 | A | 8/2007 |
| WO | WO 2006/097215 | A1 | 9/2006 |
| WO | WO 2008/028614 | A1 | 3/2008 |
| WO | 2008/042062 | A1 | 4/2008 |

OTHER PUBLICATIONS

English text machine translation of Matsuzaki (JP 05-051598 A), accessed online from the AIPN website and attached as a PDF.*

German Search Report dated Jun. 7, 2011, in DE 10 2009 027 206.2 filed Jun. 25, 2009.

Cleaner Technologies Substitutes Assessment: Professional Fabricare Processes, EPA 744-B-98-001 Jun. 1998 (13 pages).

Morris et al., "Hydrocarbon Technology Alternatives to Perchloroethylene for Dry Cleaning," Cal/EPA's Department of Toxic Substances Control, Dec. 2005 (68 pages).

* cited by examiner

*Primary Examiner* — Harold Pyon
*Assistant Examiner* — Katie L Hammer
(74) *Attorney, Agent, or Firm* — Drinker Biddle & Reath LLP

(57) ABSTRACT

The invention relates to an improved method for chemically cleaning textile, leather, or fur goods, wherein the goods to be cleaned are brought into contact with a cleaning agent, wherein the cleaning agent comprises at least one solvent, wherein according to the invention a cleaning agent is used comprising a compound of the general formula (I) as a solvent, wherein x is a whole number from 1 to 10 and $R^1$, $R^2$, $R^3$, and $R^4$ are selected independently of each other from H, a $C_1$- to $C_{22}$-alkyl radical or alkenyl radical, a polyalkylene oxide, a $C_3$- to $C_6$-cycloalkyl radical, a carbo- or heterocyclical $C_3$- to $C_6$-cycloalkenyl radical, and an aryl radical. The invention further relates to the use of a solvent having the general formula (I) for producing a cleaning agent for chemically cleaning textiles, leather, and fur goods, and a liquid cleaning agent for use in a method for chemically cleaning textile, leather, or fur goods, wherein the cleaning agent comprises a portion of a solvent having the general formula (I).

15 Claims, No Drawings

USE OF DIETHER COMPOUNDS FOR CHEMICALLY CLEANING TEXTILE, LEATHER, OR FUR GOODS

RELATED APPLICATION DATA

This application is a §371 National Stage Application of PCT International Application No. PCT/EP2010/058318 filed Jun. 14, 2010, and also claims priority under 35 U.S.C. §119 and/or §365 to German Application No. 10 2009 027 206.2, filed Jun. 25, 2009.

The present invention concerns a method of chemically cleaning textile, leather or fur goods, in which the article to be cleaned is brought into contact with a cleaning agent, wherein the cleaning agent comprises at least one solvent. In addition the present invention also concerns the use of a solvent having certain properties and features for the production of a cleaning agent for the chemical cleaning of textiles, leather and fur goods. The present invention further concerns a liquid cleaning agent for use in a method of chemically cleaning textile, leather or fur goods, wherein the cleaning agent has a proportion of a solvent having given properties and features.

Professional cleaning of textile, leather or fur goods is a specific service in modern society of commercially very great significance. Especially formal and festive clothing is usually made from high-quality materials such as for example cashmere, wool or silk or at least partially consists of leather or fur. Those materials can swell in water and, with traditional wet cleaning, also in part have a tendency to becoming matted. In addition many colors of materials which in themselves are suitable for wet cleaning suffer from low levels of wet fastness.

In general therefore the care of such goods has to be carried out in commercial textile cleaning using suitable solvents. The general advantage of a solvent treatment of textiles is that natural fibers exhibit only slight swelling behavior in organic solvents and thus the risk of matting and felting is very low.

The suitability of apolar solvents such as for example aromatic hydrocarbons, light benzenes, Stoddard solvent and white spirit for cleaning textiles has been known since the early 19th century. Later then halogen hydrocarbons such as for example chlorohydrocarbons (CHC) and fluorochlorohydrocarbons (FCHC) were also used. The FCHC which were widespread in particular in the 70s and 80s were however prohibited under the Montreal Protocol on Substances That Deplete the Ozone Layer of 1987.

In the meantime halogen-free solvents such as for example isoparaffins (HBS) and cyclosiloxane D5 (decamethylcyclopentasiloxane) have again become established in textile cleaning. When used in installations in which preparation of the solvent is effected by way of distillation those solvents have to be distilled due to their high boiling range (HBS: 185-210° C.) or boiling point (cyclosiloxane D5: boiling point: 211° C.) under reduced pressure, and that leads to correspondingly increased energy costs. To save on those there are in the meantime installations which operate without distillation or with a reduced distillation rate and which instead use filter powder or cartridge filters for solvent regeneration.

One of the most recent developments in the field is the use of liquid carbon dioxide for cleaning textiles. The high-pressure installations necessary for using liquid carbon dioxide are however markedly more expensive in comparison with conventional cleaning machines, and that has hitherto impeded the spread of the new technology.

The solvent which is most frequently used worldwide in commercial textile cleaning is perchloroethylene (=tetrachloroethene, per). Perchloroethylene is incombustible, has a boiling temperature of 121° C. and can be distilled at normal pressure in the cleaning machines. Perchloroethylene is a solvent with excellent solvent power in relation to the most widely varying forms of dirt and a large part of the superior wardrobe can be cleaned in perchloroethylene in accordance with international textile care markings.

A disadvantage in the use of perchloroethylene is the risk of ground water and soil contamination. In accordance with the Hazardous Substances Ordinance perchloroethylene is classified as harmful to health with a risk rate of R40 and is thus suspected of triggering off cancer. In some EU member states cleaning machines therefore cannot be operated with perchloroethylene in supermarkets selling foodstuffs. In addition, precautions to reduce emissions have to be implemented due to the risk of perchloroethylene vapors penetrating through brickwork. Many Federal States in the USA such as for example California have prohibited perchloroethylene as a solvent in textile cleaning as from the year 2020.

The legal conditions in regard to the use, storage and transport of perchloroethylene which is most frequently used in commercial textile cleaning lead to a need for suitable alternative solvents in commercial textile care.

Halogenated solvents have the disadvantages already mentioned above to human beings and the environment. Solvents which are considered as further alternatives such as HBS, cyclosiloxane or liquid carbon dioxide admittedly have a more favorable risk classification in comparison with perchloroethylene but in practice, particularly in the case of heavily soiled textiles and particularly in the case of soiling with pigments and salts, they do however suffer from specific disadvantages in cleaning efficiency, which can only be compensated by increased efforts in terms of spot removal.

Therefore the object of the present invention is to provide a solvent which, in regard to its cleaning properties, in comparison with perchloroethylene or the other solvents usually employed in the chemical cleaning of textile, leather or fur goods, is substantially equivalent or even better. At the same time the invention seeks to provide that said solvent has ecologically and toxicologically more favorable properties in comparison with perchloroethylene or the other solvents usually employed in the chemical cleaning of textile, leather or fur goods, so that the use, storage and transport of said solvent or a liquid cleaning agent containing said solvent is possible more safely or at lower cost and/or with lower levels of energy expenditure.

That object is attained according to the invention by the use of a solvent of the general formula (I):

(I)

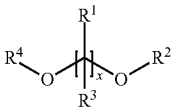

wherein x is a whole number of between 1 and 10 and $R^1$, $R^2$, $R^3$ and $R^4$ are selected independently of each other from:

- H,
- an unsubstituted or substituted, straight-chain or branched $C_1$- through $C_{22}$-alkyl residue,
- a singly or multiply unsaturated, unsubstituted or substituted, straight-chain or branched $C_1$- through $C_{22}$-alkenyl residue,
- a polyalkylene oxide selected from homo- and block-copolymers of ethylene oxide and propylene oxide, an unsubstituted or substituted, carbo- or heterocyclic $C_3$- through $C_6$-cycloalkyl residue, a singly or multiply unsaturated, unsubstituted or substituted, carbo- or heterocyclic $C_3$- through $C_6$-cycloalkenyl residue, and an aryl of the genera formula (II)

(II)

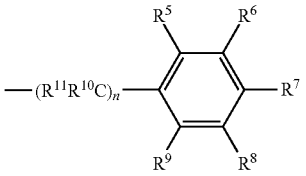

wherein n is a whole number of 0 through 22 and $R^5$, $R^6$, $R^7$, $R^8$, $R^9$, $R^{10}$ and $R^{11}$ are selected independently of each other from:

H, an unsubstituted or substituted, straight-chain or branched $C_1$- through $C_2$-alkyl residue, a singly or multiply unsaturated, unsubstituted or substituted, straight-chain or branched $C_1$- through $C_{22}$-alkenyl residue, a polyalkylene oxide selected from homo- and copolymers of ethylene oxide and propylene oxide, an unsubstituted or substituted, carbo- or heterocyclic $C_3$- through $C_6$-cycloalkyl residue, and a singly or multiply unsaturated, unsubstituted or substituted, carbo- or heterocyclic $C_3$- through $C_6$-cycloalkenyl residue in a method of chemically cleaning textile, leather or fur goods, in which the article to be cleaned in brought into contact with a cleaning agent, wherein the cleaning agent includes at least one solvent, wherein the at least one solvent is a compound of the general formula (I).

Solvents of the formula (I) are formally diether and are available by the usual synthesis paths leading to the ether function, for example by Williamson ether synthesis, the reaction of oxiranes, oxetanes, tetrahydrofurans and higher analogs with alcohols. For example in cases in which x=1 compounds of the formula (I) can occur by the reaction of a carbonyl compound such as for example an aldehyde or ketone with 2 mols of alcohol per carbonyl group. Usually that reversible reaction is acid catalyzed. To shift the equilibrium the alcohol is usually employed in excess and the resulting water is removed from the reaction mixture. In order to obtain the degree of purity required for use as a solvent in chemical cleaning it is desirable, in the cases in which acid catalysis was performed, either to remove or neutralize the catalyzing acid to prevent decomposition of the solvent upon use.

It has surprisingly been found that the cleaning capacity of compounds of the formula (I) is at least equivalent and in part even better in comparison with perchloroethylene and the other solvents conventionally used in the chemical cleaning of textile, leather and fur goods. As many compounds of the formula (I) do not have any classification, known to the inventors, under the Hazardous Substances Ordinance, they are also superior to most other solvents conventionally used in the chemical cleaning of textile, leather and fur goods, in regard to their ecological and toxicological properties. In particular the ecological and toxicological properties of many compounds of the formula (I) are better than the ecological and toxicological properties of perchloroethylene.

In addition the compounds of the formula (I) also fulfill the typical requirements for a solvent to be used in the cleaning of textile, leather and fur goods.

In particular the solvent in accordance with formula (I) has good solvent properties for oily and fatty soilings such as for example oil, fats and greases, waxes, fatty acids. In addition it also dissolves pigments and salts well off the textile fiber and stabilizes the dissolved pigments and salts in the solvent bath.

Many embodiments of the solvent in accordance with formula (I) can be distilled easily and without thermal decomposition of the solvent. In the case of certain embodiments the solvent of the formula (I) is immiscible with water and therefore if required can be really easily separated from a water phase (for example in a water separator).

In addition the solvent of the formula (I) has an advantageous drying characteristic and is substantially odor-neutral. In addition the solvent of the formula (I) does not lead to losses of color and does not adversely influence the dimensional stability of textiles. An aspect of significance is also that glues used in textile manufacture are not dissolved by the solvent of the formula (I).

In the light of this the use of the solvent in accordance with the formula (I) in a method of chemically cleaning textile, leather or fur goods, in which the article to be cleaned is brought into contact with that solvent, is extremely advantageous. When using the solvent in accordance with the formula (I) in a method of chemically cleaning textile, leather or fur goods that solvent can therefore completely or at least partially replace perchloroethylene, hydrocarbons (HBS), cyclosiloxane D5 or other solvents used for chemical cleaning.

In accordance with the present invention the goods to be cleaned (material to be cleaned) include inter alia textile, leather and fur goods of any kind such as for example articles of clothing with textile, leather and/or fur component, working and protective clothing of any kind with a textile and/or leather component but also curtains, carpets and decorative materials with a textile, leather and/or fur component.

The term chemical cleaning is to be interpreted broadly in the context of the present application and also includes preliminary treatment (spot removal) of textiles, leather and fur goods in connection with the chemical cleaning of such goods.

Preferably the article to be cleaned is brought into contact with the cleaning agent in a chemical cleaning machine. In an embodiment of the invention therefore cleaning of the textile, leather or fur goods is effected using the solvent of the formula (I) by machine in cleaning machines. Such cleaning machines are usually closed systems in which the solvent is recycled either by distillation, absorption or by a combination of both preparation procedures.

In the case of transfer installations which were used in particular in the 50s in chemical cleaning with perchloroethylene or white spirit, cleaning processes and distillation were usually carried out in the cleaning machine and drying of the textiles was performed in a separate dryer (often with solvent recovery).

Modern machines operate with the "dry to dry" technology in which the material to be cleaned is loaded dry and is also unloaded dry again after the procedure is concluded. The solvent-water mixture which has condensed at a solvent cooler can be separated into organic phase and water phase again in a water separator with that process. Then the solvent can pass by way of an overflow of the water separator into the clean tank while the water is removed from the system, as contaminated contact water, and can be suitably cleaned up to comply with the discharge limit values.

The cleaning procedures can be carried out both in a single bath and also in a double bath (preliminary and main cleaning bath) or, as for example in the case of working clothing, also in a multi-bath procedure. In the case of a double-bath or multi-bath procedure the solvent used according to the invention of the formula (I) is brought into contact with the material to be cleaned in the first bath or in a bath following the first bath. The other bath or baths can contain one or more other solvents for the chemical cleaning of textile, leather or fur goods. Alternatively the solvents used according to the invention of the formula (I) can also be brought into contact with the material to be cleaned in more than one or in all baths.

In an alternative cleaning procedure according to the present invention the solvent of the formula (I) is sprayed one or more times onto the material to be cleaned in special cleaning installations. That method can additionally also include method stages in which the material to be cleaned is immersed in one or more cleaning baths having the solvent of the formula (I), as are described in the preceding paragraph. The method may also include method stages in which the material to be cleaned is also brought into contact with another solvent for the chemical cleaning of textile, leather or fur goods, either by spraying or by being dipped into a cleaning bath.

In an embodiment of the method according to the invention the material to be cleaned is dried in the same machine in which it was also dipped or sprayed ("dry to dry" technology) so that the material to be cleaned is loaded dry and after the procedure is finished is also unloaded dried again.

Selectively in the method according to the invention after the cleaning procedure is finished and prior to the drying operation the material to be cleaned can also be sprayed with an impregnation agent or can be immersed in an impregnation agent.

In an embodiment of the invention in the solvent having the general formula (I) $R^2$ and $R^4$ can be selected independently from each other from a methyl, ethyl, n-propyl, iso-propyl, n-butyl, iso-butyl, secondary butyl, tertiary butyl, n-pentyl, iso-pentyl, neopentyl, cyclopentyl, n-hexyl, iso-hexyl, cyclohexyl, octyl, iso-octyl, 2-ethylhexyl, n-decyl, isotridecyl, phenyl, benzyl, phenylethyl and nonylphenyl residue.

In a further embodiment of the invention the solvent of the general formula (I) is characterized in that x is a whole number of between 1 and 5, $R^1$ and $R^3$ are selected independently of each other from H, an unsubstituted or substituted, straight-chain or branched $C_1$- through $C_8$-alkyl or $C_1$- through $C_8$-iso-alkyl residue, and $R^2$ and $R^4$ are selected independently of each other from an unsubstituted or substituted, straight-chain or branched $C_1$- through $C_{13}$-n-alkyl or $C_1$- through $C_{13}$-iso-alkyl residue, an unsubstituted or substituted, $C_5$- or $C_6$-cycloalkyl, phenyl, benzyl or 2-phenylethyl residue.

A further embodiment of the invention is characterized in that in the solvent of the general formula (I)

x is a whole number of between 1 and 5, $R^1$ and $R^3$ are H and $R^2$ and $R^4$ are selected independently of each other from an unsubstituted or substituted, straight-chain or branched $C_1$- through $C_8$-n-alkyl or $C_1$- through $C_8$-iso-alkyl residue.

In the embodiments of the invention in which one or more of $R^1$, $R^2$, $R^3$, $R^4$, $R^5$, $R^6$, $R^7$, $R^8$, $R^9$, $R^{10}$ or $R^{11}$ is/are substituted the substituent or substituents can be selected from the group which includes —Cl, —Br, —I, —$NO_2$, —$NR_2$, —COOR, —C(O)R, —CONHR and —$CONR_2$.

In a specific embodiment of the invention the solvent of the general formula (I) is characterized in that x=1, $R^1$ and $R^3$ are equal to H, and $R^2$ and $R^4$ are n-butyl residues.

In this specific embodiment accordingly the solvent is a compound of the specific formula (III)

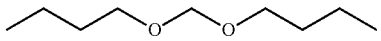

(III)

with the chemical identification of methylene glycol dibutyl ether. The solvent of the specific formula (III) is an example of an embodiment of the solvent according to the invention having the general formula (I), which has a flash point>55° C. (PMCC=Pensky-Martens Closed Cup). The solvent having the specific formula (III) is also an example of an embodiment of the solvent according to the invention of the general formula (I) which does not mix with water or which absorbs less than 2% by volume of water.

The solvent according to the invention having the formula (I) is safer, in proportion to a higher flash point thereof. In an embodiment of the invention therefore a solvent of the formula (I) is used, which has a flash point>55° C. (PMCC). For reasons of transport law a specific embodiment of the solvent of the formula (I) has a flash point≥62° C. (PMCC).

In the case of certain embodiments of the cleaning method according to the invention preparation of the cleaning agent or the solvent is effected by distillation. In the case of still more special embodiments such distillation is effected under reduced pressure (vacuum distillation). Many embodiments of the solvent used according to the invention of the formula (I) have a boiling point<215° C. at 1013 mbar. That has the advantage that the energy consumption in preparation of the solvent by distillation is lower.

In certain embodiments of the invention the cleaning agent also has a proportion of cleaning booster (or cleaning activator). In other embodiments a cleaning booster is metered to the cleaning agent during the method. In still other embodiments the article to be cleaned is brought into contact with a cleaning booster separately during the method in another fashion.

Cleaning boosters (or cleaning activators) are surfactant formulations for improving the cleaning effect. The further functions of a cleaning booster include the emulsification of water to improve wet dirt removal, and the dispersion of pigments and salts in the solvent to improve detachment thereof from the textile fabric and to prevent re-deposition thereof. Many cleaning boosters stabilize dissolved fine pigments in the cleaning bath and thus protect the material to be cleaned from graying. Cleaning boosters can also be anti-corrosion additives or non-ionic or cationic surfactants for feel improvement with "easy finish" properties or finishes. Many cleaning boosters provide for hygiene effects in textile care while others reduce or avoid static charging of the material to be cleaned during the drying phase, whereby for example in the case of wool fluff formation is markedly reduced.

In certain embodiments of the invention the cleaning agent has a proportion of cleaning booster which is selected from anionic surfactants, cationic surfactants, non-ionic surfactants, amphoteric surfactants, microbicides, preserving agents, feel improvers, finishes, fragrance substances, water, preserving agents, odor absorbers, dissolving intermediaries, corrosion inhibitors, deodorants, emulsifiers, finishing agents, anti-static components, fluorocarbon resins or combinations thereof.

The anionic surfactants considered here include sulfates, sulfonates, carboxylates, phosphates such as for example alkylester sulfonates, alkyl sulfates, alkylether sulfates, alkylbenzol sulfonates, alkane sulfonates and fatty acids, which are suitable for the man skilled in the art as cleaning boosters for the chemical cleaning of textile, leather and fur goods, in conjunction with cations, which can be selected for example from alkali or alkaline earth metals such as for example lithium, sodium, potassium or ammonium or ammonium compounds such as for example monoethanol amine, diethanol amine and triethanol amine.

The non-ionic surfactants considered here include the condensation products, known to the man skilled in the art as cleaning boosters for the chemical cleaning of textile, leather and fur goods, of aliphatic alcohols with alkylene oxide, for example ethylene oxide or propylene oxide, wherein the alkyl chain of the aliphatic alcohols can be straight-chain or branched, saturated or unsaturated, condensation products of ethylene oxide with a hydrophobic base which is formed by condensation of propylene oxide with propylene glycol, and condensation products of ethylene oxide with a reaction product of propylene oxide and ethylene diamine. The possible non-ionic surfactants further include water-soluble amine oxides, water-soluble phosphine oxides and water-soluble sulfoxides with a $C_{10}$- through $C_{18}$-alkyl residue. Further non-ionic surfactants known to the man skilled in the art as cleaning boosters for the chemical cleaning of textile, leather and fur goods are alkyl and alkenyl oligoglycosides and fatty acid polyglycol esters or fatty amine polyglycol esters with a $C_8$- through $C_{20}$-fatty alkyl residue, alkoxylated triglycamides, fatty acid-N-alkyl glucamides, phosphine oxides, dialkyl sulfoxides, mixed ethers or mixed formyls and protein hydrolysates as well as polyethylene, propylene and polybutylene oxide condensates of alkylphenols.

Examples of amphoteric or zwitterionic surfactants are alkyl betaines, alkyl amido betaines, alkyl dimethyl betaines, alkyl dipolyethoxy betaines, amino propionates, amino glycinates and amphoteric imidazolinium compounds which are known to the man skilled in the art as cleaning boosters for the chemical cleaning of textile, leather and fur goods.

The cationic surfactants which are known to the man skilled in the art as cleaning boosters for the chemical cleaning of textile, leather and fur goods include substituted or unsubstituted, straight-chain or branched, quaternary ammonium salts of the type $R^1N(CH_3)_3{}^+X^-$, $R^1R^2N(CH_3)_3{}^+X^-$, $R^1R^2R^3N(CH_3)^+X^-$ or $R^1R^2R^3R^4N^+X^-$, wherein $R^1$, $R^2$, $R^3$ and $R^4$ can be an alkyl, hydroxyalkyl, phenyl, alkenyl or aralkyl residue, wherein $X^-$ is an anion known to be suitable to the man skilled in the art.

In certain embodiments the cleaning agent also has a proportion of a substance suitable for chemical cleaning agents for trapping hydrogen proton donors, free hydrogen protons and/or free carbonyl compounds. For example by the addition of basic compounds suitable for that purpose the cleaning agent can be stabilized in that any proton donors present are caught in a neutralization reaction and cannot contribute to a proton-catalyzed decomposition of the solvent.

The aforementioned substances, suitable for chemical cleaning agents, for trapping hydrogen proton donors, free hydrogen protons and/or free carbonyl compounds can be selected without limitation thereto from alkali metal carbonates such as for example sodium or potassium carbonate, and compounds which bear one or more free amino groups such as for example chitin, urea, aminoguanidine, phenylbiguanidine, (polymeric) aminophenols and amino group-bearing ion exchangers. The compounds which bear one or more free amino groups are capable of binding carbonyl compounds forming Schiff's bases (azomethines). At the same time those amino compounds react as bases and react with proton donors in a neutralization reaction with the formation of ammonium compounds. Due to that pH stabilization, acid-catalyzed hydrolysis reactions which possibly occur and which lead to the decomposition of the solvent are prevented or at least markedly limited.

The substances which are suitable for chemical cleaning agents for trapping hydrogen proton donors, free hydrogen protons and/or free carbonyl compounds are preferably of a higher boiling point than the other substances of the cleaning agent and are temperature-stable so that upon distillation of the chemical cleaning agent they remain behind in the distillation still and do not come into communication with the material to be cleaned. If the compounds are not soluble in the cleaning agent then alternatively they can also be put into the cleaning agent which is stored in a storage tank so that in that case they also do not come into contact with the material to be cleaned. The trap reaction of protons and carbonyl compounds occurs here in a heterogeneous reaction and can also be envisaged in relation to non-distilling cleaning procedures.

In certain embodiments the cleaning agent also has a proportion of a solvent which is suitable for the cleaning of textile, leather or fur goods and which is different from the solvent of the formula (I). In other embodiments, during the process, there is added to the cleaning agent a solvent which is suitable for the cleaning of textile, leather or fur goods and which is different from the solvent of the formula (I). In still other embodiments the article to be cleaned is brought into contact during the method in some other way separately with a solvent which is suitable for the cleaning of textile, leather or fur goods and which is different from the solvent of the formula (I).

The other solvents which are suitable for the cleaning of textile, leather or fur goods and which are different from the solvent of the formula (I) include all solvents which are suitable for the cleaning of textile, leather or fur goods and which are different from the solvent of the formula (I), such as for example the conventional solvents used in chemical cleaning, referred to in the opening part of this specification. In particular the solvents which are suitable for the cleaning of textile, leather or fur goods and which are different from the solvent of the formula (I) include perchloroethylene, aromatic hydrocarbons, light benzenes, Stoddard solvent, white spirit, chlorohydrocarbons, fluorochlorohydrocarbons, isoparaffins (HBS), cyclosiloxane D5, liquid carbon dioxide and combinations thereof.

In a further aspect of the present invention the above-described solvent having the general formula (I) is used in one or more various ones of the above-described embodiments for the production of a cleaning agent for the chemical cleaning of textile, leather and fur goods or for the production of an agent for the preliminary treatment (spot removal) of textiles, leather and fur goods, wherein said cleaning agent selectively has one or more of the features described hereinbefore for cleaning agents according to the invention.

For example the correspondingly produced cleaning agent, in certain embodiments, besides a proportion of a cleaning agent having the general formula (I), also has a proportion of a cleaning booster and/or a proportion of another solvent which is suitable for the cleaning of textile, leather or fur goods and which is different from the solvent of the formula (I).

In still a further aspect of the present invention the use of a liquid cleaning agent in a method of chemically cleaning textile, leather or fur goods is claimed, wherein the cleaning agent has a proportion of a solvent of the general formula (I) in one or more different ones of the above-described embodiments and a proportion of a cleaning booster and/or a proportion of another solvent which is suitable for the cleaning of textile, leather or fur goods and which is different from the solvent formula (I), and wherein the chemical cleaning operation is preferably effected in a chemical cleaning machine.

For the purposes of the original disclosure it is pointed out that all features as can be seen by a man skilled in the art from the present description, the drawings and the claims, even if they are described in specific terms only in connection with certain other features, can be combined both individually and also in any combinations with others of the features or groups of features disclosed herein insofar as that has not been expressly excluded or technical aspects make such combinations impossible or meaningless. A comprehensive explicit representation of all conceivable combinations of features is dispensed with here only for the sake of brevity and readability of the description.

The invention claimed is:

1. A method of dry cleaning comprising bringing an article to be cleaned into contact with a cleaning agent comprising a solvent of the general formula (I):

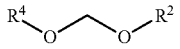

(I)

wherein $R^1$ and $R^2$ are selected independently of each other from the group consisting of an unsubstituted or substituted, straight-chain or branched $C_2$- through $C_8$-n-alkyl or $C_2$- through $C_8$-iso-alkyl residue.

2. The method as set forth in claim 1 wherein $R^1$ and $R^2$ are selected independently from each other from the group consisting of an ethyl, n-propyl, n-butyl, iso-butyl, secondary butyl, tertiary butyl, n-pentyl, iso-pentyl, neopentyl, n-hexyl, iso-hexyl, octyl, iso-octyl, 2-ethylhexyl residue.

3. The method as set forth in claim 1 wherein substituted $R^1$, $R^2$, if present, are substituted with one or more from —Cl, —Br, —I, —$NO_2$, —$NR_2$, —COOR, —C(O)R, —CONHR and —$CONR_2$.

4. The method as set forth in claim 1 wherein the at least one solvent is a compound of the formula (III):

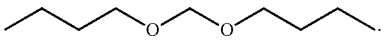

(III)

5. The method as set forth in claim 1 wherein the solvent has a flash point of >55° C.

6. The method as set forth in claim 1 wherein the cleaning agent also has a proportion of a cleaning booster or a cleaning booster is meteredly added to the cleaning agent during the method or the article to be cleaned is also brought into contact with a cleaning booster during the method.

7. The method as set forth in claim 1 wherein the cleaning agent additionally includes a substance selected from the group consisting of an alkali metal carbonate and a compound which bears one or more free amino groups.

8. The method as set forth in claim 1 wherein the cleaning agent also has a proportion of another solvent which is suitable for the cleaning of textile, leather or fur goods and which is different from the solvent of the formula (I) or another solvent which is suitable for the cleaning of textile, leather or fur goods and which is different from the solvent of the formula (I), wherein the other solvent is meteredly added to the cleaning agent during the method or the article to be cleaned is also brought into contact with another solvent which is suitable for the cleaning of textile, leather or fur goods and which is different from the solvent of the formula (I) during the method.

9. The method as set forth in claim 1, wherein the cleaning agent further comprises at least one substance selected from the group consisting of a cleaning booster; an alkali metal carbonate; a compound which bears one or more free amino groups; and another solvent which is suitable for the cleaning of textile, leather or fur goods and which is different from the solvent of the general formula (I).

10. The method as set forth in claim 9 wherein the cleaning booster is selected from the group consisting of anionic surfactants, cationic surfactants, non-ionic surfactants, amphoteric surfactants, microbicides, preserving agents, feel improvers, finishes, fragrance substances, water, preserving agents, odor absorbers, anti-static components, dissolving intermediaries, corrosion inhibitors, deodorants, emulsifiers, finishing agents, fluorocarbon resins or combinations thereof.

11. The method as set forth in claim 9 wherein the other solvent which is suitable for the cleaning of textile, leather or fur goods and which is different from the solvent of the general formula (I) is selected from the group consisting of perchloroethylene, aromatic hydrocarbons, light benzenes, Stoddard solvent, white spirit, chlorohydrocarbons (CHC), fluorochlorohydrocarbons (FCHC), isoparaffins (HBS) and cyclosiloxane D5 (decamethylcyclopentasiloxane) and combinations thereof.

12. The method as set forth in claim 1 wherein the solvent has a flash point of ≥62° C.

13. The method as set forth in claim 1 wherein the solvent has a boiling point of <215° C. at 1013 mbar.

14. The method as set forth in claim 1 wherein the article to be cleaned is a textile, leather or fur good.

15. The method as set forth in claim 1 further comprising contacting the article with the cleaning agent in a cleaning machine that is a closed system in which the solvent is recycled.

* * * * *

UNITED STATES PATENT AND TRADEMARK OFFICE

CERTIFICATE OF CORRECTION

PATENT NO. : 8,801,807 B2
APPLICATION NO. : 13/123606
DATED : August 12, 2014
INVENTOR(S) : Cord Meyer et al.

It is certified that error appears in the above-identified patent and that said Letters Patent is hereby corrected as shown below:

In the Claims

Column 9, lines 28-32 (Claim 1), the formula should appear as follows:

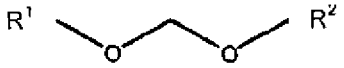

Signed and Sealed this
Ninth Day of June, 2015

Michelle K. Lee

Michelle K. Lee
*Director of the United States Patent and Trademark Office*